US010378762B2

(12) United States Patent
Shimizu et al.

(10) Patent No.: US 10,378,762 B2
(45) Date of Patent: Aug. 13, 2019

(54) EQUIPMENT SAFETY MANAGEMENT DEVICE, EQUIPMENT SAFETY MANAGEMENT METHOD, AND NATURAL GAS LIQUEFACTION DEVICE

(71) Applicant: CHIYODA CORPORATION, Yokohama-shi, Kanagawa (JP)

(72) Inventors: Yasunori Shimizu, Yokohama (JP); Tsuneo Watanabe, Yokohama (JP)

(73) Assignee: CHIYODA CORPORATION, Yokohama-shi, Kanagawa (JP)

( * ) Notice: Subject to any disclaimer, the term of this patent is extended or adjusted under 35 U.S.C. 154(b) by 187 days.

(21) Appl. No.: 15/532,480

(22) PCT Filed: Dec. 1, 2014

(86) PCT No.: PCT/JP2014/081688
§ 371 (c)(1),
(2) Date: Jun. 1, 2017

(87) PCT Pub. No.: WO2016/088159
PCT Pub. Date: Jun. 9, 2016

(65) Prior Publication Data

US 2017/0336071 A1 Nov. 23, 2017

(51) Int. Cl.
*F23G 7/08* (2006.01)
*F17D 5/02* (2006.01)
(Continued)

(52) U.S. Cl.
CPC ..... *F23G 7/085* (2013.01); *F17C 13/04* (2013.01); *F17D 5/02* (2013.01); *F25J 1/0022* (2013.01);
(Continued)

(58) Field of Classification Search
CPC ..... F17C 13/04; F17D 8/02; F25J 1/0022
(Continued)

(56) References Cited

U.S. PATENT DOCUMENTS 2,844,160 A * 7/1958 Polk ..... F16K 13/10 137/115.14
3,123,981 A 3/1964 Carney et al.
(Continued)

FOREIGN PATENT DOCUMENTS

CN 202274285 U 6/2012
JP S57-051097 A 3/1982
(Continued)

OTHER PUBLICATIONS

CIPO, Office Action dated Oct. 1, 2018 in CA Patent Application No. 2,969,333, total 3 pages.
(Continued)

*Primary Examiner* — Vivek K Shirsat
(74) *Attorney, Agent, or Firm* — Masuvalley & Partners

(57) ABSTRACT

An equipment safety management device for managing safety of equipment capable of holding fluid is provided. The equipment safety management device includes: a safety means configured to be in fluid communication with an outlet of the equipment, the safety means being brought into a released state when pressure of the equipment reaches a previously set pressure, the safety means delivering the fluid to a flare pipe, which is fluidly communicated; and, as the flare pipe, at least one first flare pipe allowing a low-temperature fluid to flow therethrough and at least one second flare pipe allowing an aqueous fluid to flow therethrough. The safety means can deliver the fluid to both the first flare pipe and the second flare pipe.

10 Claims, 3 Drawing Sheets

(51) Int. Cl.

| | |
|---|---|
| ***F17C 13/04*** | (2006.01) |
| ***F25J 1/00*** | (2006.01) |
| ***F25J 1/02*** | (2006.01) |
| *F17C 13/00* | (2006.01) |

(52) U.S. Cl.
CPC ..... *F25J 1/0087* (2013.01); *F25J 1/0216* (2013.01); *F25J 1/0298* (2013.01); *F17C 13/00* (2013.01); *F17C 2205/0332* (2013.01); *F17C 2260/042* (2013.01); *F23G 2207/102* (2013.01); *F23G 2208/00* (2013.01); *F25J 2290/90* (2013.01)

(58) Field of Classification Search
USPC ..... 431/202, 2, 5
See application file for complete search history.

(56) References Cited

U.S. PATENT DOCUMENTS

| | | | | |
|---|---|---|---|---|
| 3,608,324 | A | 9/1971 | Singleton et al. | |
| 3,842,613 | A | 10/1974 | Becker | |
| 3,915,620 | A * | 10/1975 | Reed | F23G 5/50 422/112 |
| 4,858,640 | A | 8/1989 | Kaufmann | |
| 5,572,875 | A | 11/1996 | Gustafson | |
| 2012/0125042 | A1 * | 5/2012 | Loewen | C10L 3/101 62/619 |

FOREIGN PATENT DOCUMENTS

| | | | |
|---|---|---|---|
| JP | 2000-027792 | A | 1/2000 |
| JP | 2001-304497 | A | 10/2001 |
| JP | 2010-025152 | A | 2/2010 |
| RU | 2153128 | C2 | 7/2000 |
| WO | 2012/043274 | A1 | 4/2012 |

OTHER PUBLICATIONS

IP Australia, Examination Report No. 1 dated Jun. 12, 2018 in AU Patent Application No. 2014413034, total 6 pages.
International Search Authority/JPO, International Search Report dated Mar. 3, 2015 in International Patent Application No. PCT/JP2014/081688 (with English translation), 4 pages.

* cited by examiner

EQUIPMENT SAFETY MANAGEMENT DEVICE, EQUIPMENT SAFETY MANAGEMENT METHOD, AND NATURAL GAS LIQUEFACTION DEVICE

RELATED APPLICATIONS

This application is the U.S. National Phase application under 35 U.S.C. § 371 of International Patent Application No. PCT/JP2014/081688, International Filing Date Dec. 1, 2014, entitled "EQUIPMENT SAFETY MANAGEMENT DEVICE, EQUIPMENT SAFETY MANAGEMENT METHOD, AND NATURAL GAS LIQUEFACTION DEVICE", which is hereby expressly incorporated by reference in its entirety for all purposes.

TECHNICAL FIELD

The present invention relates to an equipment safety management device, an equipment safety management method, and a natural gas liquefaction device, and more particularly to an equipment safety management device, an equipment safety management method, and a natural gas liquefaction device that can be used in a natural gas liquefaction plant (LNG plant) or the like.

BACKGROUND OF DISCLOSURE

For liquefaction of natural gas, an LNG (liquefied natural gas: Liquefied Natural Gas) plant generally requires a pretreatment process where a liquid component (condensate) is separated from natural gas sent from a gas field, an acid gas removal process where an acid gas (hydrogen sulfide, carbon dioxide or the like) which is an environmental pollutant is removed, a process where mercury which is detrimental to a liquefaction device is removed, a dehydration process where moisture is removed by an adsorbent or the like, a liquefaction process where natural gas is liquefied in a liquefaction facility, and the like. In addition, in these gas treatment or liquefaction processes or the like, equipment, e.g., a gas compressor, is used (see, for example, Patent Literature 1: JP 2010-25152 A).

Regarding the equipment used, e.g., a compressor, in order to secure safety of the equipment, when the pressure or the like of a hydrocarbon (hydrocarbon)-containing fluid held in the equipment reaches a previously set pressure, a safety means, e.g., a safety valve and a depressurization valve, connected to the equipment is activated and is brought into a released state, so that the fluid within the equipment is released and transferred to a flare pipe which is connected in a fluid communicable manner to the safety means. In addition, the fluid sent from the flare pipe is combusted in a flare and is discharged out of the plant (liquefaction device).

FIG. 4 is a diagram schematically illustrating a conventional equipment safety management device 100. As illustrated in FIG. 4, conventionally, equipment 101 is in fluid communication with an outlet 102 of equipment and is brought into a released state when the pressure of the equipment 101 reaches a previously set pressure, and the equipment 101 is connected in a fluid communicable manner to a safety means 103 that delivers the fluid to a flare pipe 104 (first flare pipe 104), which is fluidly communicated. With this configuration, an excessive elevation of the pressure of the equipment 101, e.g., a compressor, is prevented. Additionally, in order to allow the fluid to flow from other equipment 107 via a safety means 108, a second flare pipe 105 (flare pipe 105) is disposed as a flare pipe in addition to the first flare pipe 104. The destination of connection of the safety means 103, e.g., a safety valve and a depressurization valve, is the single flare pipe 104, as illustrated in FIG. 4. It is previously determined to which flare pipe to allow the fluid within the equipment 101 to flow from the equipment 101 depending on its temperature or the degree of water content: the flare pipe 104 (first flare pipe) for flowing a fluid below the freezing point (low-temperature fluid) or the flare pipe 105 (second flare pipe) for flowing a moisture-containing fluid (aqueous fluid) (in FIG. 4, the first flare pipe 104). Based on the above, the safety means 103 and the flare pipe 104 are designed so that the operation pressure of the equipment 101 does not exceed the design pressure and the fluid is released to the flare pipe. Thus, the safety management of the equipment 101 is performed.

SUMMARY OF THE INVENTION

The flare pipe requires a size sufficient enough to send the entire amount of fluid released from the safety means, e.g., a safety valve, to the flare. However, when the amount of fluid released from the safety means for protecting a single piece of equipment or a system is abundant, a single flare pipe sends the fluid and thus has a large size. There has been a problem that an increase in size of the flare pipe results in high cost of associated facilities or the like, e.g., the cost of manufacturing a flare pipe or a flare header (hereinafter sometimes simply referred to as the "flare pipe"), the cost of introducing a large-sized flare pipe or the like into a plant, and the cost of increasing the size of a pipe rack on which the flare pipe is placed. For such a problem, conventionally, an attempt has been made only in a limited extent to reduce the size of a flare pipe or the like on the basis of results obtained by analysis of dynamic simulation or the like.

The present invention has been made to overcome the aforementioned problem, and it is an object of the present invention to provide an equipment safety management device, an equipment safety management method, and a natural gas liquefaction device capable of managing safety of equipment as well as reducing costs by reducing the flow rate of fluid per flare pipe and reducing the size of the flare pipe, for example, in a system typified by an LNG plant using equipment, e.g., a compressor.

To solve the aforementioned problem, according to the present invention, there is provided an equipment safety management device for managing safety of equipment capable of holding fluid, the equipment safety management device including: a safety means configured to be in fluid communication with an outlet of the equipment, the safety means being brought into a released state when pressure of the equipment reaches a previously set pressure, the safety means delivering the fluid to a flare pipe, which is fluidly communicated; and as the flare pipe, at least one first flare pipe allowing a low-temperature fluid to flow therethrough and at least one second flare pipe allowing an aqueous fluid to flow therethrough, wherein the safety means can deliver the fluid to both the first flare pipe and the second flare pipe.

According to the equipment safety management device described above, the safety means includes a plurality of valves, and the plurality of valves are released in stages according to an increase in pressure of the equipment.

According to the equipment safety management device described above, the equipment safety management device further includes a determination portion configured to determine whether the fluid can be delivered to both the first flare pipe and the second flare pipe.

According to the equipment safety management device described above, the equipment is a compressor.

According to the present invention, there is provided an equipment safety management method in which a safety means connected in a fluid communicable manner to an outlet of equipment capable of holding fluid is brought into a released state when pressure of the equipment reaches a previously set pressure so that the fluid is delivered to a flare pipe, which is fluidly communicated, the equipment safety management method including: including, as the flare pipe, at least one first flare pipe allowing a low-temperature fluid to flow therethrough and at least one second flare pipe allowing an aqueous fluid to flow therethrough; and delivering the fluid delivered from the safety means and capable of being flown to both the first flare pipe and the second flare pipe to both the first flare pipe and the second flare pipe.

According to the equipment safety management method described above, the safety means includes a plurality of valves, and the plurality of valves are released in stages according to an increase in pressure of the equipment.

According to the equipment safety management method described above, the equipment safety management method further includes: determining whether the fluid can be delivered to both the first flare pipe and the second flare pipe; and when the fluid can be delivered, delivering the fluid to both the first flare pipe and the second flare pipe.

According to the equipment safety management method described above, the determination determines whether the fluid is neither an aqueous fluid nor a low-temperature fluid.

According to the equipment safety management method described above, the equipment is a compressor.

According to the present invention, there is provided a natural gas liquefaction device including: equipment capable of holding fluid; and the equipment safety management device described above.

According to the natural gas liquefaction device described above, the equipment is at least one of a C3 compressor, an MR compressor and a C3-MR compressor.

According to the present invention, when the pressure of a fluid held in the equipment reaches a predetermined pressure, the fluid can be split and delivered to two types of flare pipes: a first flare pipe and a second flare pipe. Thus, the equipment safety management device and the equipment safety management method can be provided whereby an excessive elevation of the pressure of the equipment can be prevented and the safety of the equipment can be managed securely, and, in addition, the size of a flare pipe or a flare header to be used can be reduced so that the construction cost of a plant or a device to which the equipment is introduced, e.g., the manufacturing cost of the flare pipes, the cost pertaining to introduction into a plant, and the cost of increasing the size of a pipe rack on which the flare pipes are placed, can be reduced.

In addition, the natural gas liquefaction device of the present invention including the aforementioned equipment safety management device enjoys the effect provided by the safety management device and is capable of accurately managing the safety of the equipment constituting the liquefaction device as well as reducing the size of the flare pipes so as to reduce the construction cost of the entire liquefaction device.

DETAILED DESCRIPTION OF THE INVENTION

An example of an embodiment of the present invention is described below on the basis of the drawings.

Figure 1:
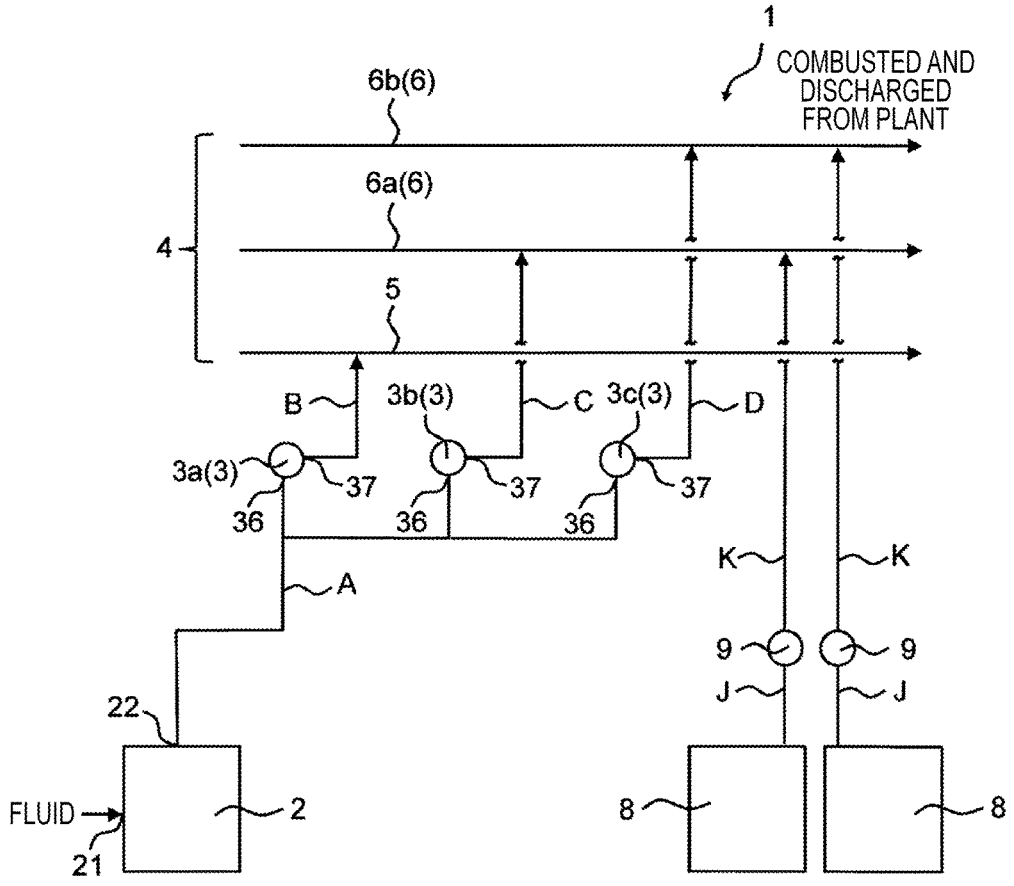
FIG. 1 is a diagram schematically illustrating an equipment safety management device according to the present invention.

An equipment safety management method according to the present invention is described below in conjunction with an equipment safety management device 1 illustrated in FIG. 1. FIG. 1 is a diagram schematically illustrating the equipment safety management device 1 according to the present invention. In the drawing, reference numeral 1 denotes a safety management device, reference numeral 2 denotes equipment, reference numeral 3 denotes a safety means, reference numeral 4 denotes a flare pipe, reference numeral 5 denotes a first flare pipe, reference numeral 6 denotes a second flare pipe, and reference signs A to D denote pipes. In addition, in FIG. 1, the flare pipe 4 (the second flare pipe 6 in FIG. 1) allows the fluid from other equipment 8 to flow therethrough, and the other equipment 8 and the flare pipe 4 are connected in a fluid communicable manner via a safety means 9 by pipes J, K.

Regarding the equipment safety management device 1 (hereinafter sometimes simply referred to as the "safety management device 1") according to the present invention, FIG. 1 illustrates an aspect in which the equipment 2, which is a subject to be managed by the safety management device 1, includes an inlet 21 through which the fluid is introduced to the inside and an outlet 22 through which the fluid is delivered to the outside. In addition, the equipment safety management device 1 includes, as essential configurations, a safety means 3 that is in fluid communication with the outlet 22 of the equipment and is brought into a released state when the pressure of the equipment 2 reaches a previously set pressure to deliver the fluid into the flare pipe 4, which is fluidly communicated, and, as the flare pipe 4, at least one first flare pipe (cold flare pipe) 5 through which a low-temperature fluid can flow and at least one second flare pipe (wet flare pipe) 6 through which an aqueous fluid can flow.

In the present invention, the safety means 3 connected in a fluid communicable manner to the outlet 22 of the equipment for delivering the introduced fluid to the outside is brought into a released state when the pressure of the equipment 2 exceeds a previously set pressure, and delivers the fluid to the flare pipe 4, which is connected in a fluid communicable manner to outlets 37 (the outlets 37 of the safety valves 3*a*, 3*b*, 3*c*) of the safety means, and the fluid sent is delivered from the flare pipe 4 to a flare, which is not illustrated, and is combusted, and is discharged out of the plant (liquefaction device). In this manner, an excessive elevation of the pressure of the equipment 2 is prevented, and the safety of the equipment 2 is managed.

Hydrocarbon (hydrocarbon)-containing fluid is conceivable as the fluid that is delivered into and held in the equipment 2 through the inlet 21 and delivered to the outside through the outlet 22. The fluid includes those in the form of gas (gas), those in the form of a gas-liquid mixture, and those in the form of liquid (liquid form). Examples of the fluid in cases where the safety management device 1 according to the present invention is applied to a natural gas liquefaction plant or a liquefaction device include a single fluid composed of one of the types including methane, ethane and propane, or a mixed fluid composed of two or more types of the above.

In the present invention, as described above, the equipment 2, which is subjected to safety management, is not particularly limited insofar as the hydrocarbon (hydrocarbon)-containing fluid can be held. However, examples include relatively large-capacity towers and vessels or the like, e.g., a compressor (compression machine) and a distillation tower. Additionally, the equipment 2 does not necessarily include the feature of pressure rising. However, the pressure is assumed to rise due to input of heat from the outside including fire and the inflow of high-pressure fluid from the outside. Therefore, in such a case, the safety means 3 works. In addition, the equipment 2 is not particularly limited insofar as the fluid can be held. The equipment 2 is a concept that covers, for example, a tank.

Examples of the compressor being the equipment 2 include, but not limited to, various compressors such as an off-gas compressor, a refrigerant gas compressor, a boil-off gas (BOG) compressor, and a fuel gas compressor for use in a natural gas liquefaction plant or a liquefaction device. In addition, as the relatively large-capacity towers and vessels, other examples of the equipment 2 include, but not limited to, a distillation tower, a rectification tower, an extraction tower, an absorption tower, a scrubbing tower, a desulfurization tower, a regeneration tower, a reaction tower, a mixing vessel, a fermentation vessel, and a culture vessel.

The safety means 3 is in fluid communication with the outlet 22 of the equipment. As illustrated in FIG. 1, the present embodiment indicates an aspect in which the outlet 22 of the equipment is connected in a fluid communicable manner to the inlets 36 (the inlets 36 of the safety valves 3*a*, 3*b*, 3*c*) of the safety means 3 by the pipe A. The safety means 3 is brought into a released state when the pressure of the equipment 2 reaches a previously set pressure and delivers the fluid to the flare pipe 4, which is fluidly communicated. For example, in a system where the fluid passes through the safety means 3, the valve, which is closed normally (indicating a state before the pressure reaches a previously set pressure), is opened and brought into a released state. Thus, the pressure of the equipment 2 is prevented from exceeding a previously set pressure. In the present embodiment, as illustrated in FIG. 1, it is indicated that the safety means 3 is in a state of including the three safety valves 3*a*, 3*b*, 3*c*. The safety valve 3*a* is connected to the first flare pipe 5 via the pipe B, the safety valve 3*b* is connected to the second flare pipe 6*a* via the pipe C, and the safety valve 3*c* is connected to the second flare pipe 6*b* via the pipe D. Additionally, the word "being in fluid communication" according to the present invention means that multiple devices or the like are communicated in a state where the fluid can pass through a pipe or the like, for example, between the equipment 2 and the safety means 3 and between the safety means 3 and the flare pipe 4.

Examples of the safety means 3 include a conventionally publicly known safety valve or depressurization valve the released state of which is adjusted by opening and closing of the valve. The safety valve includes a valve (opening and closing valve) that is automatically brought into a released state when the pressure of the equipment 2 connected reaches a previously set pressure. The depressurization valve includes a valve (opening and closing valve) that is brought into a released state by human operation when the pressure of the equipment connected reaches a previously set pressure. Additionally, as the "pressure of the equipment 2," the internal pressure of the equipment 2, the pressure of the fluid within the equipment 2, the discharged pressure of the fluid delivered through the outlet 22 of the equipment, or the like may be measured and used as an index. In addition, in the present embodiment, the safety means 3 is described in conjunction with the safety valves 3*a*, 3*b*, 3*c* having a valve function.

Regarding the safety means 3, the inlets 36 are brought into fluid communication with the outlet 22 of the equipment, and the outlets 37 of the safety means 3 are brought into fluid communication with the flare pipe 4. In the present embodiment, the safety means 3 is in a state of being connected in a fluid communicable manner to the flare pipe 4 (the first flare pipe 5 and the second flare pipe 6; the same applies hereinafter) via the pipes B, C, D. When the equipment 2 reaches a previously set pressure and the safety means 3 is brought into a released state, the fluid from the equipment 2 is delivered to the flare pipe 4. In the present invention, the flare pipe 4 to which the fluid from the safety means 3 is delivered includes at least one first flare pipe 5 through which fluid below the freezing point (low-temperature fluid) can flow and at least one second flare pipe 6 through which moisture-containing fluid (aqueous fluid) can flow. In the present embodiment, as illustrated in FIG. 1, an aspect of including one first flare pipe 5 and two second flare pipes 6*a*, 6*b* is indicated.

The first flare pipe (cold flare (Cold Flare) pipe) 5 is the flare pipe 4 for flowing the fluid below the freezing point (low-temperature fluid), which allows the flow of the low-temperature fluid, but does not allow the flow of the moisture-containing fluid (aqueous fluid). However, regarding the temperature of fluid, the low-temperature fluid as well as a fluid higher in temperature than the low-temperature fluid can flow. Additionally, when an aqueous fluid flows into the first flare pipe (cold flare pipe) 5, in some cases, the aqueous fluid is frozen and blocks the first flare pipe 5.

Similarly, the second flare (wet flare (Wet Flare) pipe 6 is the flare pipe 4 for flowing the moisture-containing fluid (aqueous fluid), which allows the flow of the aqueous fluid, but does not allow the flow of the low-temperature fluid. However, regarding the aqueous state of fluid, the aqueous fluid as well as a fluid not containing moisture can flow. When a low-temperature fluid flows into the second flare (wet flare pipe) 6, in some cases, the moisture within the second flare pipe 6 is frozen and blocks the second flare pipe 6.

Additionally, the word "low-temperature fluid" indicates a fluid below the freezing point. In addition, the word "aqueous fluid" indicates a moisture-containing fluid regardless of the concentration of fluid.

Table 1 indicates a relationship between the fluid that can flow into the aforementioned first flare pipe 5 and second flare pipe 6 and the fluid that cannot flow thereinto (a relationship between the flare pipe 4 and the fluid). In Table 1, symbol "○" indicates that "the flow is allowed", and symbol "x" indicates that "the flow is not allowed".

(Relationship Between the Flare Pipe 4 and the Fluid)

TABLE 1

| | LOW-TEMPERATURE FLUID | | NON-LOW TEMPERATURE FLUID | |
|---|---|---|---|---|
| | AQUEOUS FLUID | NON-AQUEOUS FLUID | AQUEOUS FLUID | NON-AQUEOUS FLUID |
| FIRST FLARE PIPE | x | ○ | x | ○ |
| SECOND FLARE PIPE | x | x | ○ | ○ |

As indicated in Table 1, for example, when the fluid is neither a low-temperature fluid nor an aqueous fluid, the fluid can flow into both the first flare pipe 5 and the second flare pipe 6. Such a fluid may be released to any of the first flare pipe 5 and the second flare pipe 6 from the equipment 2. For example, in the case of Blocked Outlet of a C3 (propane) compressor, Blocked Outlet of a mixed refrigerant (MR) compressor (MR compressor), or Blocked Outlet of a combined C3-MR compressor in a natural gas liquefaction plant (LNG plant), the above fluid is released in large amounts. Thus, the fluid that is neither a low-temperature fluid nor an aqueous fluid is effective. In addition, it is assumed that immediately before and after removal of moisture of Feed Gas when Feed Gas (feed gas) blows through, the fluid (Feed Gas), which is neither a low-temperature fluid nor an aqueous fluid, flows. The fluid can be flown into both of the first flare pipe 5 and the second flare pipe 6.

Figure 2:
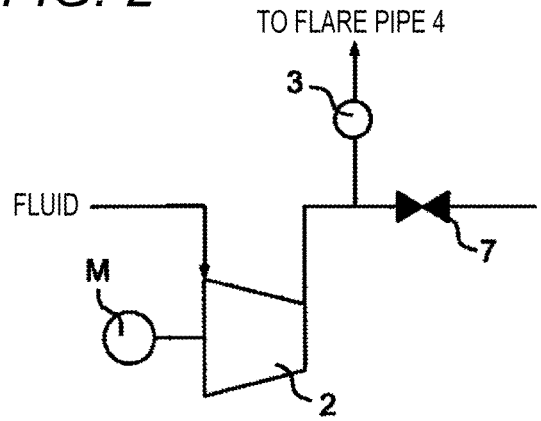
FIG. 2 is a diagram illustrating a system of Blocked Outlet of a compressor.

FIG. 2 is a diagram illustrating a system of Blocked Outlet of a compressor. In such a system of Blocked Outlet or the like of an MR compressor or C3 compressor, an opening and closing valve 7 that is in an opened state during normal time and is brought into a closed state during failure is often attached. In addition, in FIG. 2, drive equipment M (motor, gas turbine or the like) is attached to a compressor 2, which is the equipment (in the example illustrated in FIG. 2, the drive equipment M is a motor). While the drive equipment M drives the compressor 2, when a failure occurs and the opening and closing valve 7 is closed, the fluid within the compressor 2 is increased in pressure as the compressor 2 is driven by the drive equipment M. When the pressure of the fluid reaches a predetermined pressure, the safety means 3 is brought into a released state, and the fluid flows from the compressor 2 to the flare pipe 4 (the first flare pipe 5 and the second flare pipe 6).

In the system of the MR compressor, the C3 compressor, or the like, refrigerant is introduced into the equipment (refrigerant compressor) 2 as the fluid. However, when the amount of fluid is relatively small, the fluid is not increased to a high temperature even by being increased in pressure by the equipment 2, and often remains as a low-temperature fluid. The same applies in the case of Back Flow of the MR compressor (backflow to the MR compressor), or the like. In this case, when the pressure of the equipment 2 reaches a previously set pressure and the safety means 3 is brought into a released state, the fluid remains as a low-temperature fluid and is delivered out of the equipment. Therefore, as the flare pipe 4 for fluid delivery, only the first flare pipe 5 is selected. In contrast, when the amount of fluid is relatively large and the fluid is increased in pressure and increased to a high temperature by the equipment 2, it is assumed that a large amount of (a relatively high-temperature) fluid, which is neither a low-temperature fluid nor an aqueous fluid, is released from the equipment 2. In this case, when the pressure of the equipment 2 reaches a previously set pressure, the fluid, which is neither a low-temperature fluid nor an aqueous fluid, is delivered out of the equipment 2 as the safety means 3 is released. Therefore, the fluid can be delivered to the two types of flare pipe 4: the first flare pipe 5 and the second flare pipe 6.

In addition, in such a system, generally, the application of the first flare pipe (cold flare pipe) 5 through which a low-temperature fluid can flow is dominant. Conventionally, on the basis of the assumption that a low-temperature fluid flows, a large amount of fluid flows to the single first flare pipe 5 through which a low-temperature fluid can flow, but not to the second flare pipe 6 through which a low-temperature fluid cannot flow. As a result, it has been needed to increase the size of the first flare pipe 5. In reality, when the amount of fluid is relatively large, as described above, the (relatively high-temperature) fluid, which is neither a low-temperature fluid nor an aqueous fluid, is released, in some cases, the fluid can be delivered to the two types of flare pipes: the first flare pipe 5 and the second flare pipe 6. In view of the above, the present invention provides the two types of flare pipe 4: the first flare pipe 5 and the second flare pipe 6, which are connected in a fluid communicable manner to the outlets 37 of the safety means 3, and divides and delivers the fluid to the two types of flare pipes 5, 6, and thus the size of the flare pipe 4 or a flare header, which is not illustrated, for connection thereof can be reduced.

The flare pipe 4 or a flare header of an LNG plant generally has a large size. However, an increase in size (an increase in diameter) results in higher cost. For safety management of the equipment 2, the present invention includes, as the flare pipe 4, at least one first flare pipe 5 through which a low-temperature fluid can flow and at least one second flare pipe 6 through which an aqueous fluid can flow, and, when the pressure of the equipment 2 reaches a previously set pressure, the safety means 3 is brought into a released state, so that the fluid delivered from the safety means 3 is delivered to both the first flare pipe 5 and the second flare pipe 6. In this manner, the fluid can be separately flown to not only the first flare pipe 5, but also the second flare pipe 6. Therefore, it is economical that, in a system where the application of the first flare pipe (cold flare pipe) 5 is dominant, the size of the first flare pipe 5 can be reduced.

In addition, the safety means 3 may be regarded as a single system including the multiple valves 3*a*, 3*b*, 3*c*. When the safety means 3 includes multiple valves as described above, the multiple valves may be set to be brought into a released state in stages according to an increase in pressure of the equipment. When the safety means 3 includes a single valve, a small amount of fluid can be handled, but when the amount of fluid is large, regarding the safety means 3, e.g., a safety valve and a depressurization valve, the valve is repeatedly opened and closed so as to be or not to be brought into a released state, resulting in a reduction in operation efficiency, which is not beneficial in terms of the safeness of the equipment 2. Thus, when a large amount of fluid is expected to flow, the safety means 3 may include multiple valves to increase the operation efficiency and the safeness.

FIG. 1 illustrates an aspect in which the safety valve 3*a* connected to the first flare pipe 5, the safety valve 3*b* connected to the second flare pipe 6*a*, and the safety valve 3*c* connected to the second flare pipe 6*b* are present. However, for example, the safety valves 3*a*, 3*b*, 3*c* may be brought into a released state (activated) in stages according to an increase in pressure of the equipment 2 as follows: when an upper limit pressure (previously set pressure) that the equipment 2 can withstand is assumed to be "p", when the pressure of the equipment 2 becomes 90% (0.9 p) of p, the safety valve 3*a* is brought into a released state, and the fluid is released to the first flare pipe 5, next, when the pressure of the equipment 2 becomes 95% (0.95 p) of p, the safety valve 3*b* is brought into a released state, and the fluid is released to the second flare pipe 6*a*, and finally, when the pressure of the equipment 2 becomes 100% (1.0 p) of p, the safety valve 3*c* is brought into a released state, and the fluid is released to the second flare pipe 6*b*. With the above configuration, the operation efficiency and the safeness can be further increased. Additionally, the aforementioned degrees of the pressure p of the equipment 2 (90%→95%→100%) are a mere example, and may be properly determined depending on the type of safety means 3 to be used, the number of valves, the numbers and sizes of the first flare pipe 5 and the second flare pipe 6, the size of the equipment 2, the type of fluid, the pressure of the equipment 2, which is an index, or the like.

With the safety management device 1 and the safety management method according to the present embodiment described above, when the pressure of a fluid held in the equipment 2 reaches a previously set pressure, the fluid can be split and delivered to the two types of flare pipe: the first flare pipe 5 and the second flare pipe 6. Therefore, an excessive elevation of the pressure of the equipment 2 can be prevented, and the safety of the equipment 2 can be managed securely. In addition, the size of the flare pipe 4 (first flare pipe 5) or a flare header can be reduced, and the construction cost of a plant, e.g., the manufacturing cost of the flare pipe 4, the cost pertaining to introduction into a plant, and the cost of increasing the size of a pipe rack on which the flare pipe 4 is placed, can be reduced.

Generally, there are multiple cases where the safety means 3 connected in a fluid communicable manner to the equipment 2 is activated. In each of the multiple cases, a designer of the safety means 3 checks the properties (temperature of the fluid and the presence or absence of water content) of the fluid present in the equipment 2. Among the multiple cases, the present invention can be effectively applied in cases where the fluid (which is, for example, neither the low-temperature fluid nor the aqueous fluid) that have to be flown to the limited flare pipe 4 (e.g., the first flare pipe 5) in small amounts, but can be flown to both the first flare pipe 5 and the second flare pipe 6 in large amounts is delivered out of the equipment 2. In this case, in this case, it may be configured and carried out in the following manner: some of the safety valves of the safety means 3 are connected to an appropriate flare pipe 4 on the basis of the assumption that the amount of fluid delivered out of the equipment 2 is small, and the remaining safety valves are connected to a flare pipe 4 (e.g., the second flare pipe 6) which is different from those to which the aforementioned small amount is delivered (for example, in FIG. 1, it is configured such that the safety valve 3*a* is connected to the first flare pipe 5 and the safety valves 3*b*, 3*c* are connected to the second flare pipe 5).

The safety management device 1 according to the present invention may be applied, for example, to a natural gas liquefaction device (or a natural gas liquefaction plant). When the safety management device 1 is applied to a natural gas liquefaction device, for example, one conceivable configuration or the like would be as follows: the safety means 3 is disposed in fluid communication with the outlet 22 of the equipment, and at least one first flare pipe 5 through which a low-temperature fluid can flow and at least one second flare pipe 6 through which an aqueous fluid can flow are disposed in fluid communication with the outlets 37 of the safety means with regard to the pieces of equipment 2 including a compressor in the natural gas liquefaction plant (LNG plant), for example, a C3 compressor, an MR compressor, or a combined C3-MR compressor, another compressor (e.g., a fuel gas compressor) in the liquefaction plant (LNG plant) for liquefied natural gas of natural gas, and relatively large-capacity towers and vessels or the like, e.g., a distillation tower, as described above.

Similarly, in the liquefaction device configured in the above manner, when the pressure of the fluid held in the equipment 2 reaches a predetermined pressure, the safety means 3 is brought into a released state, and the fluid can be split and delivered to the two types of flare pipe 4: the first flare pipe 5 and the second flare pipe 6. The natural gas liquefaction device of the present invention including the safety management device 1 with the aforementioned configuration or the like is capable of accurately managing the safety of the equipment 2 as well as reducing the size or the like of the flare pipe 4 and reducing the construction cost of the device.

Additionally, the aspect described above indicates one aspect of the present invention. The present invention is not limited to the aforementioned embodiment, however, needless to mention, variations and improvements including the configuration of the present invention within the scope where the object and the effect can be achieved are covered by the content of the present invention. In addition, there is no problem even if a specific structure, shape, or the like in carrying out the present invention may be a different structure, shape, or the like within the scope where the object and the effect of the present invention can be achieved. The present invention is not limited to each embodiment described above, and variations and improvements within the scope where the object of the present invention can be achieved are covered by the present invention.

For example, in the aforementioned embodiment, the equipment safety management device 1 installed with respect to an event, e.g., Blocked Outlet of the C3 compressor, Blocked Outlet of the MR compressor, or Blocked Outlet of the combined C3-MR compressor in a natural gas liquefaction plant is described by assuming the system where, as the fluid, the fluid that can be flown to both the first flare pipe 5 and the second flare pipe 6 is introduced to the equipment 2. In the present invention, the fluid (introduced into the equipment 2, including the fluid within the equipment 2; the same applies hereinafter) delivered through the outlet 22 of the equipment is determined as to whether it can be delivered to both the first flare pipe 5 and the second flare pipe 6, and when it can be delivered, the fluid may be delivered to both the first flare pipe 5 and the second flare pipe 6. Such a configuration is capable of corresponding to a system where a type of fluid cannot be predicted in advance, thereby enjoying the aforementioned effect and enabling efficient safety management.

For such determination, it is preferable to provide a determination portion, which is not illustrated, for determining whether the fluid delivered through the outlet 22 of the equipment can be delivered to both the first flare pipe 5 and the second flare pipe 6 is provided, such that the determination portion determines whether the fluid can be flown to both the first flare pipe 5 and the second flare pipe 6.

The determination portion checks the type of fluid and determines whether the fluid can be flown to both the first flare pipe 5 and the second flare pipe 6. For example, it may be configured such that a sensor (not illustrated) for checking the type of fluid is provided, for example, within the equipment 2 or the pipe A connected to the inlets 36 of the safety means, information of the fluid from the sensor is communicated to a determination device (not illustrated), the determination device determines whether the fluid can be flown to both the first flare pipe 5 and the second flare pipe 6 according to the type of fluid and communicates the information of determination results to the safety means 3.

Furthermore, when the safety means 3 receives information indicating that the fluid can be flown to both the first flare pipe 5 and the second flare pipe 6 as, for example, the fluid is neither a low-temperature fluid nor an aqueous fluid, it is sufficient that, when the pressure of the equipment 2 reaches a previously set pressure, the safety means 3 is brought into a released state so that the fluid is delivered to the first flare pipe 5 and the second flare pipe 6.

In the aforementioned embodiment, as illustrated in FIG. 1, the safety means 3 and the flare pipe 4 (the first flare pipe 5 and the second flare pipe 6) connected to the safety means 3 are described by indicating the aspect including the safety valve 3*a* connected to the first flare pipe 5, the safety valve 3*b* connected to the second flare pipe 6*a*, and the safety valve 3*c* connected to the second flare pipe 6*b*. The numbers of safety valves, first flare pipes 5, and second flare pipes 6, and the configuration of connection of the first flare pipe 5 and the second flare pipe 6 to the safety means 3 or the like are not limited thereto. The numbers and the configuration of connection or the like may be arbitrarily determined insofar as there are at least one first flare pipe 5 and at least one second flare pipe 6.

Additionally, in the description below, structures similar to those of the aforementioned embodiment and members which are the same as those of the aforementioned embodiment are designated with the same reference numerals, and the detailed description thereof is omitted or simplified.

Figure 3:
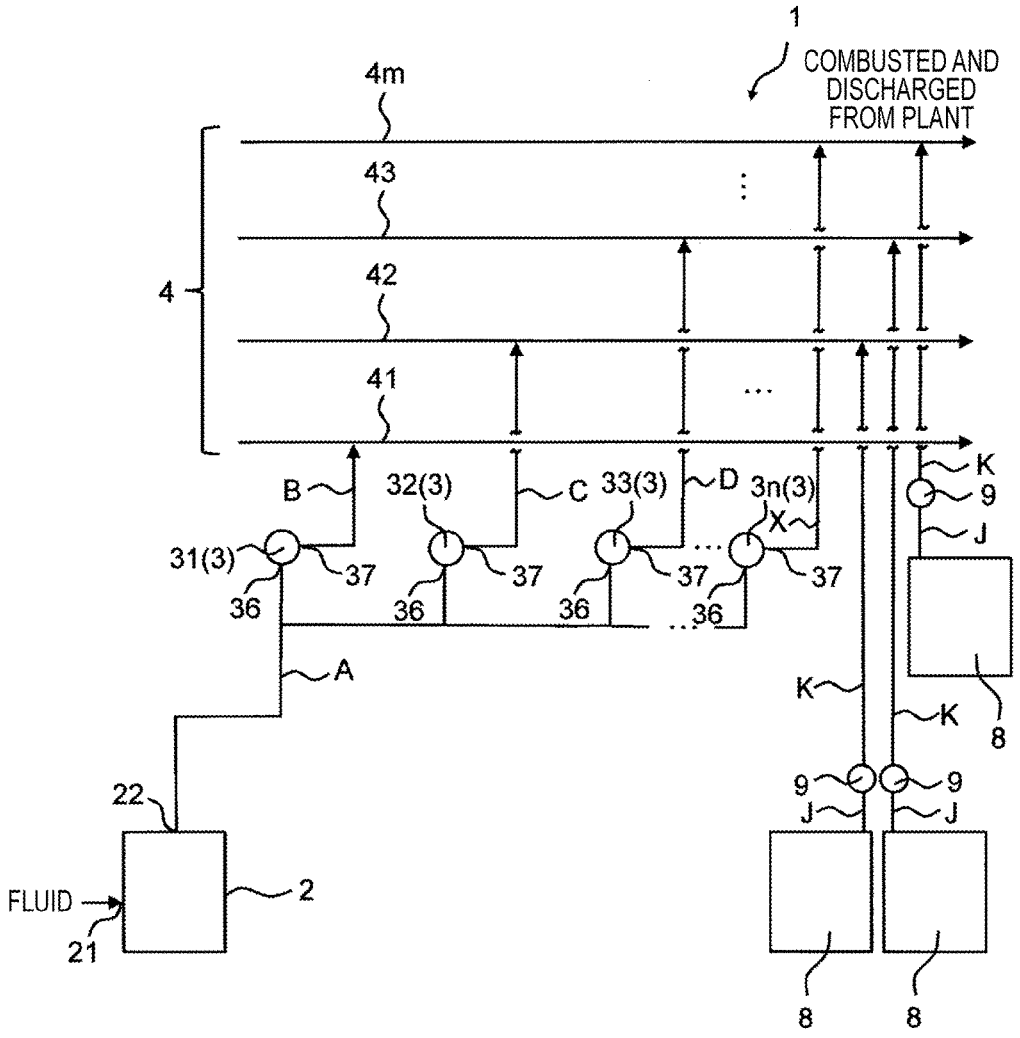
FIG. 3 is a diagram schematically illustrating another aspect of the equipment safety management device according to the present invention.

FIG. 3 is a diagram schematically illustrating another aspect of the equipment safety management device 1 according to the present invention. In FIG. 3, symbol m denotes the number of flare pipes 4 (number) (in FIG. 3, flare pipes 41, 42, 43, . . . , 4*m* are indicated. As the flare pipe 4, the numbers, the installation positions, or the like are arbitrarily determined insofar as there are at least one first flare pipe 5 and at least one second flare pipe 6), and symbol n denotes the number of safety valves (number) (similarly, safety valves 31, 32, 33, . . . , 3*n* are indicated).

Figure 4:
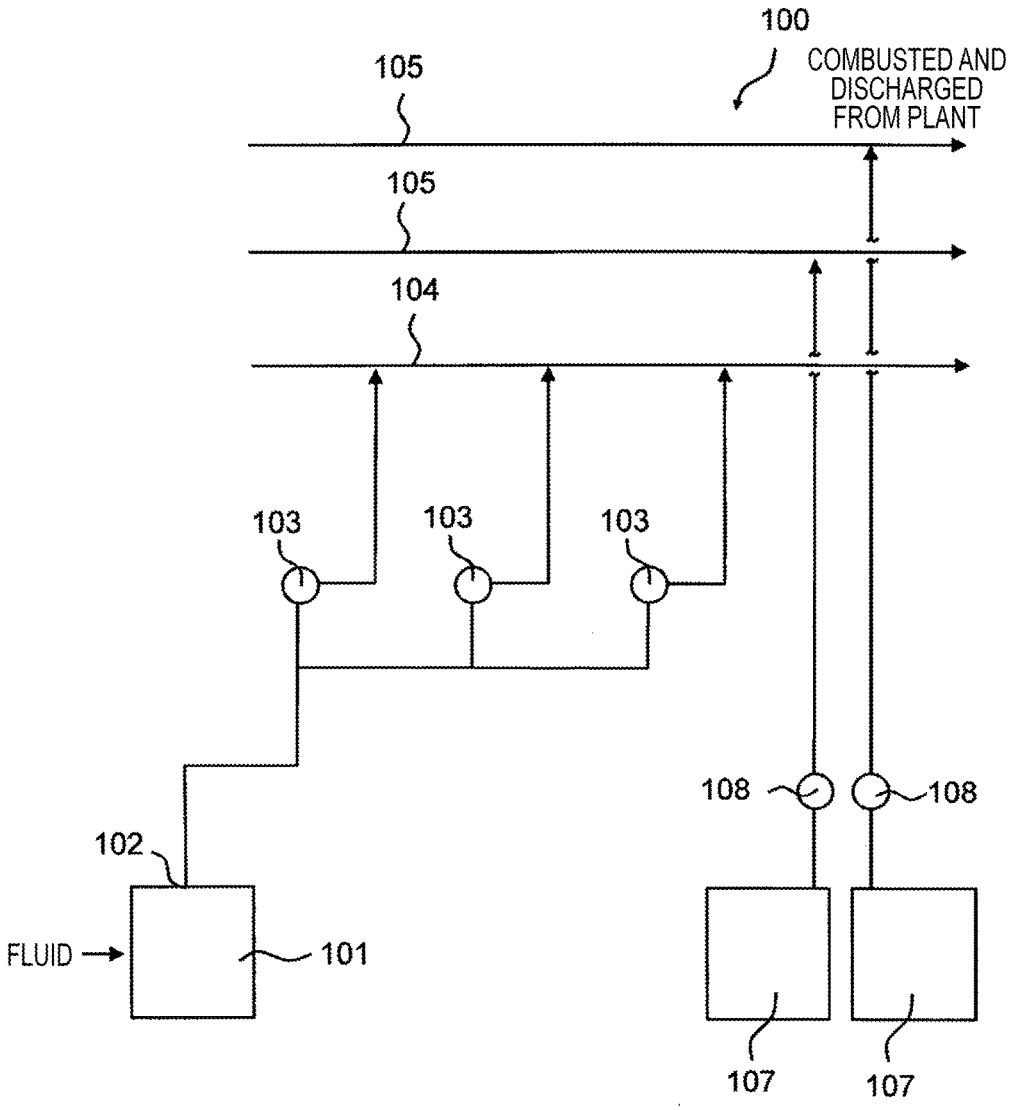
FIG. 4 is a diagram schematically illustrating a conventional equipment safety management device.

As illustrated in FIG. 3, regarding the safety means 3 and the flare pipe 4, a safety valve 31 is connected in a fluid communicable manner to a flare pipe 41 via a pipe B, a safety valve 32 is connected in a fluid communicable manner to a flare pipe 42 via a pipe C, a safety valve 33 is connected in a fluid communicable manner to a flare pipe 43 via a pipe D, and a safety means 3*n* is connected in a fluid communicable manner to a flare pipe 4*m* via a pipe X. When the flare pipe 41 is assumed to be the first flare pipe 4, symbol 4*m* denotes an m-th flare pipe 4, indicating an integer of two or more (in FIG. 4, an integer of four or more because the third flare pipe 43 is indicated). Similarly, when the safety valve 31 is assumed to be the first safety valve, symbol 3*n* denotes an n-th safety valve, indicating an integer of two or more (in FIG. 4, an integer of four or more because the third safety valve 33 is indicated). Symbols m and n may be configured such that m=n, but may also be configured such that m≠n. As an example is illustrated in FIG. 3, in the present invention, the safety means 3 and the flare pipe 4 connected to the safety means 3 of the safety management device 1 may be arbitrarily determined by one or multiple safety valves, and at least one first flare pipe 5 and at least one second flare pipe 6 connected in a fluid communicable manner to the safety valves.

Additionally, the safety means 3 illustrated in FIGS. 1 and 3 according to the aforementioned embodiment is described in conjunction with the safety valves 3*a*, 3*b*, 3*c*, 3*n* having a valve function as the safety means 3, but is not limited thereto. For example, when a safety valve or a depressurization valve is used as the safety means 3, all the safety means 3 may be a safety valve and all the safety means 3 may be a depressurization valve. In addition, a safety valve and a depressurization valve may exist together in one safety means 3.

In addition, in the present invention, as illustrated in FIGS. 1 and 3, the aspect in which one safety valve 3*a*, 31 is connected to one flare pipe 4 is indicated. However, the number of safety valves connected to one first pipe 4, e.g., the first flare pipe 5 and the second flare pipe 6, is arbitrary. For example, one safety valve may be connected to multiple flare pipes 4 or multiple safety valves may be connected to one flare pipe 4 such that the fluid is delivered.

In the aforementioned embodiment, an example of the system where the application of the first flare pipe (cold flare pipe) 5 is dominant is given. However, the present invention is not limited thereto, but may be used in another system where the application of the first flare pipe 5 is not dominant.

Moreover, a specific structure, shape or the like in carrying out the present invention may be another structure or the like within the scope where the object of the present invention can be achieved.

The present invention is highly industrially applicable since it can be advantageously used as a means of enabling safety management of equipment, e.g., a compressor, and reducing the construction cost of various plants and devices, e.g., an LNG plant.

The invention claimed is:

1. An equipment safety management device for managing safety of equipment capable of holding a fluid, the equipment safety management device comprising:

a safety means configured to be in fluid communication with an outlet of the equipment, the safety means being brought into a released state when pressure of the equipment reaches a previously set pressure, the safety means delivering the fluid to a flare pipe, which is fluidly communicated; and the flare pipe including at least one first flare pipe allowing a low-temperature fluid to flow therethrough, but blocking an aqueous fluid to flow and at least one second flare pipe allowing an aqueous fluid to flow therethrough, but blocking the low-temperature fluid to flow, wherein the safety means delivers the fluid to both the first flare pipe and the second flare pipe when the fluid held in the equipment is neither a low-temperature fluid nor an aqueous fluid.

2. The equipment safety management device according to claim 1, wherein the safety means includes a plurality of valves, and the plurality of valves are released in stages according to an increase in pressure of the equipment.

3. The equipment safety management device according to claim 1, further comprising a determination portion configured to determine whether the fluid held in the equipment can be delivered to both the first flare pipe and the second flare pipe.

4. The equipment safety management device according to claim 1, wherein the equipment is a compressor.

5. An equipment safety management method in which a safety means connected in a fluid communicable manner to an outlet of equipment capable of holding fluid is brought into a released state when pressure of the equipment reaches a previously set pressure so that the fluid is delivered to a flare pipe, which is fluidly communicated, the flare pipe including at least one first flare pipe allowing a low-temperature fluid to flow therethrough, but blocking an aqueous fluid to flow and at least one second flare pipe allowing an aqueous fluid to flow therethrough, but blocking the low-temperature fluid to flow, the equipment safety management method comprising:

delivering the fluid from the safety means to both the first flare pipe and the second flare pipe when the fluid held in the equipment is neither a low-temperature fluid nor an aqueous fluid.

6. The equipment safety management method according to claim 5, wherein the safety means includes a plurality of valves, and the plurality of valves are released in stages according to an increase in pressure of the equipment.

7. The equipment safety management method according to claim 5, wherein the equipment is a compressor.

8. A natural gas liquefaction device comprising:

equipment capable of holding fluid; and the equipment safety management device according to claim 1.

9. The natural gas liquefaction device according to claim 8, wherein the equipment is at least one of a C3 compressor, an MR compressor and a C3-MR compressor.

10. The equipment safety management device according to claim 2, further comprising a determination portion configured to determine whether the fluid held in the equipment can be delivered to both the first flare pipe and the second flare pipe.

* * * * *